US006740278B2

(12) United States Patent
Chang

(10) Patent No.: US 6,740,278 B2
(45) Date of Patent: May 25, 2004

(54) METHOD OF MAKING INSTALLATION ZONE FOR CERAMIC DOLL EYE AND STRUCTURE THEREOF

(76) Inventor: Alex Chang, 1F, No. 43-1, Wan-Shou Rd., Wen-Shan Dist., Taipei City (TW)

( * ) Notice: Subject to any disclaimer, the term of this patent is extended or adjusted under 35 U.S.C. 154(b) by 0 days.

(21) Appl. No.: 10/265,573

(22) Filed: Oct. 8, 2002

(65) Prior Publication Data

US 2004/0067715 A1 Apr. 8, 2004

(51) Int. Cl.[7] ..... B29C 65/00
(52) U.S. Cl. ..... 264/222; 446/392
(58) Field of Search ..... 446/389, 392; 156/61; 264/31, 222, 239

(56) References Cited

U.S. PATENT DOCUMENTS 4,596,683 A * 6/1986 Powell ..... 264/46.4
4,753,412 A * 6/1988 Johnson ..... 249/55
5,863,363 A * 1/1999 Sankey ..... 156/61

* cited by examiner

*Primary Examiner*—Jacob K. Ackun
(74) *Attorney, Agent, or Firm*—Birch, Stewart, Kolasch & Birch, LLP

(57) ABSTRACT

A method of making an installation zone for a ceramic doll eye and a structure thereof includes the steps of: forming a doll head model; planting an eye model in a model eye cavity with an anchor sleeve extending from the front end of the eye model outside the head model; casting a head mold according to the head model; releasing the mold to leave the anchor sleeve in the mold eye cavity of the head mold; coupling another eye model on the anchor sleeve; casting the head mold to form a head finished product; and removing the eye mold from the eye cavity of the head finished product to form an installation zone on the inner peripheral wall of the eye cavity for installing a doll eyeball.

5 Claims, 10 Drawing Sheets

METHOD OF MAKING INSTALLATION ZONE FOR CERAMIC DOLL EYE AND STRUCTURE THEREOF

FIELD OF THE INVENTION

The present invention relates to a method of making an installation zone for a ceramic doll eye and a structure thereof, and particularly a method of forming an installation zone of a selected shape for an eye on the inner peripheral wall of the eye cavity of a ceramic doll.

BACKGROUND OF THE INVENTION

Ceramic dolls such as those mimic human being or animals have a great appeal to many people. Many countries are known for their production of delicate ceramic dolls. Lively eyes are an important feature for the ceramic dolls. Thus many lifelike eyeballs have been developed to replace the painted eyes on the ceramic dolls. However, to install a pair of eyeballs on the ceramic doll is a tedious and time-consuming process.

At present, installing a pair of eyes on the ceramic doll head involves many operations. They generally include: making a semi-finished product by casting a gypsum mold; carving a pair of eye cavities for holding doll eyeballs before the semi-finished product is dry; scraping the inner peripheral wall of the eye cavities to form a curved and smooth inner wall surface for holding the doll eyeballs; baking the semi-finished product in a kiln to become a finished product; finally disposing the eyeballs into the eye sockets of the doll and coating a layer of adhesive on the rear side of the eyeballs to fasten the eyeballs (as shown in FIG. 1). The process of installing the doll eyeballs set forth above has the following disadvantages:

1. Human eye focus changes according to the viewing direction. However the focus of the doll eyes is fixed. Workers who install the doll eyeballs have to adjust the positions of the eyeballs constantly to avoid producing skew or askance looking eyes.
2. The eye cavities on the head of dolls usually have a limited size due to aesthetic considerations. It is difficult for workers to place hands or tools into the eye cavities to make adjustment for the eyeballs.
3. Installation of the eyeballs often requires to patch a layer of clay on the rear side of the eyeballs. The process could inadvertently move the eyeballs away from their proper positions and spoil all the previous focus adjustment operations.
4. Some producers have developed blinking doll eyes. The blinking eye is covered by a layer of fastening section different from the conventional arched doll eyeballs. The doll eye making methods at present cannot support the blinking eyeball.

SUMMARY OF THE INVENTION

Therefore the primary object of the invention is to resolve the aforesaid disadvantages. The invention provides a method of making an installation zone for a ceramic doll eye and a structure thereof. According to the invention, a doll eye installation zone is formed in a doll eye cavity that enables a doll eyeball be installed easily and precisely in the head of the doll without the need of repetitive adjustments.

Another object of the invention is to provide a %head model or a head mold that is reusable repeatedly.

In order to achieve the foregoing objects, the method of the invention includes the steps of: making a head model of a doll; planting an eye model in a model eye cavity with an anchor sleeve extending from the front end of the eye model outside the head model; casting a head mold according to the head model; releasing the head mold with the anchor sleeve remains in the eye cavity of the head mold; coupling another eye model on the anchor sleeve; casting the head mold to form a head finished product; and removing the eye mold from the head finished product to form an eyeball installation zone on the inner peripheral wall of the eye cavity in the head finished product. Then workers may easily and precisely install the eyeball of the doll in the installation zone.

The foregoing, as well as additional objects, features and advantages of the invention will be more readily apparent from the following detailed description, which proceeds with reference to the accompanying drawings, which are given by way of illustration only, and thus are not limitative of the present invention.

DESCRIPTION OF THE PREFERRED EMBODIMENT

Figure 1:
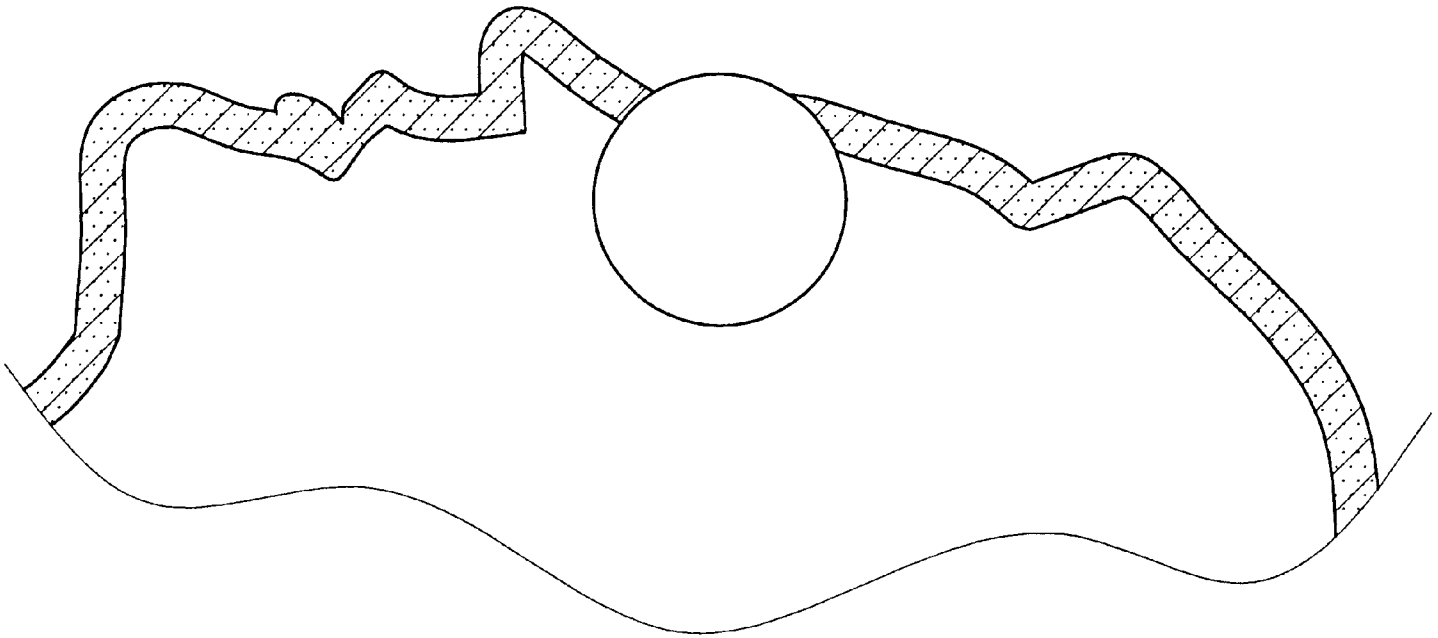
FIG. 1 is a schematic cross section of the head of a conventional ceramic doll.
Figure 2:
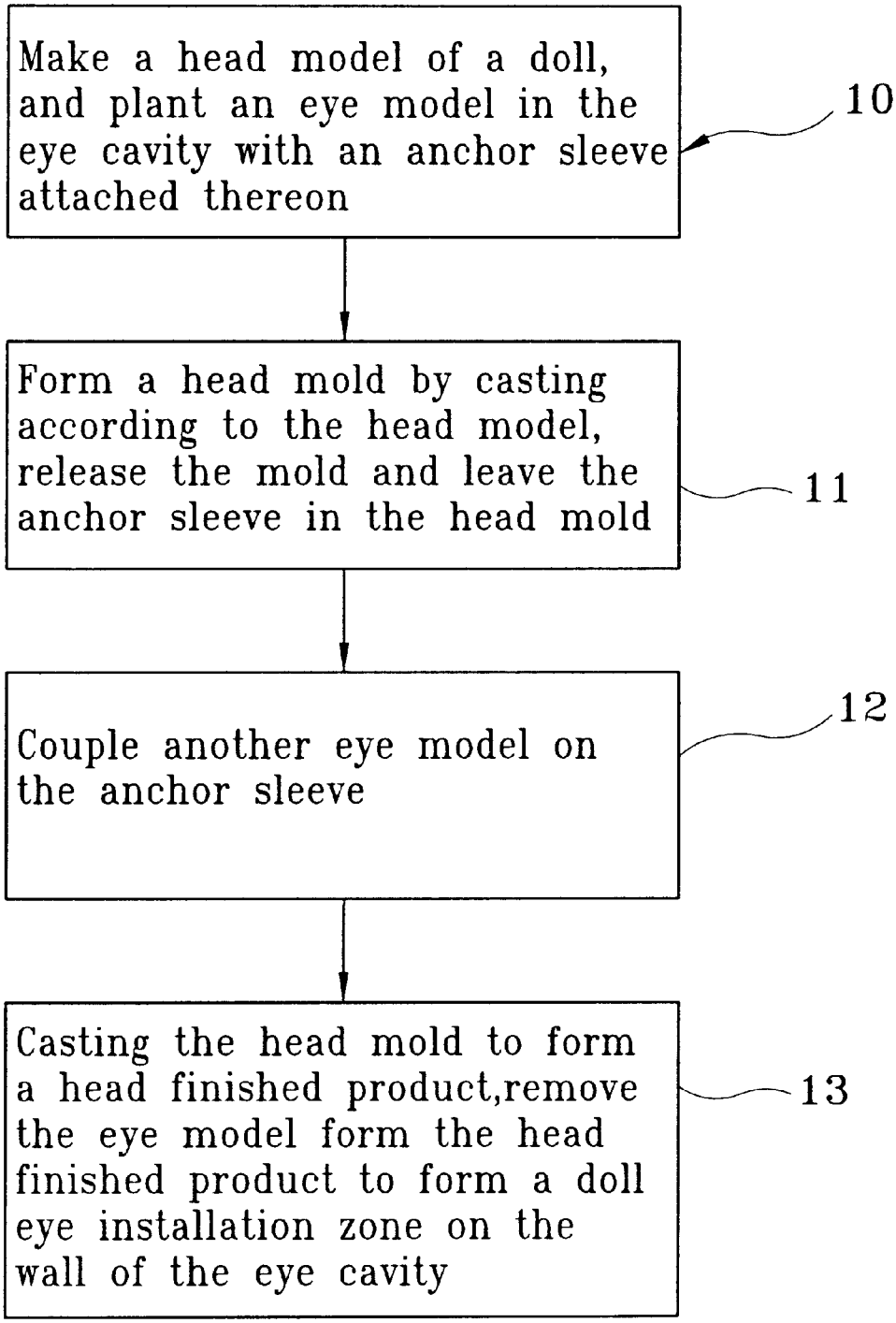
FIG. 2 is the process flow of the invention.

Refer to FIG. 2 for the manufacturing process of the invention. The method and structure of the invention aim at forming an eye installation zone in the eye cavity of a doll to enable workers to install the doll eyeball easily.

Figure 3A:
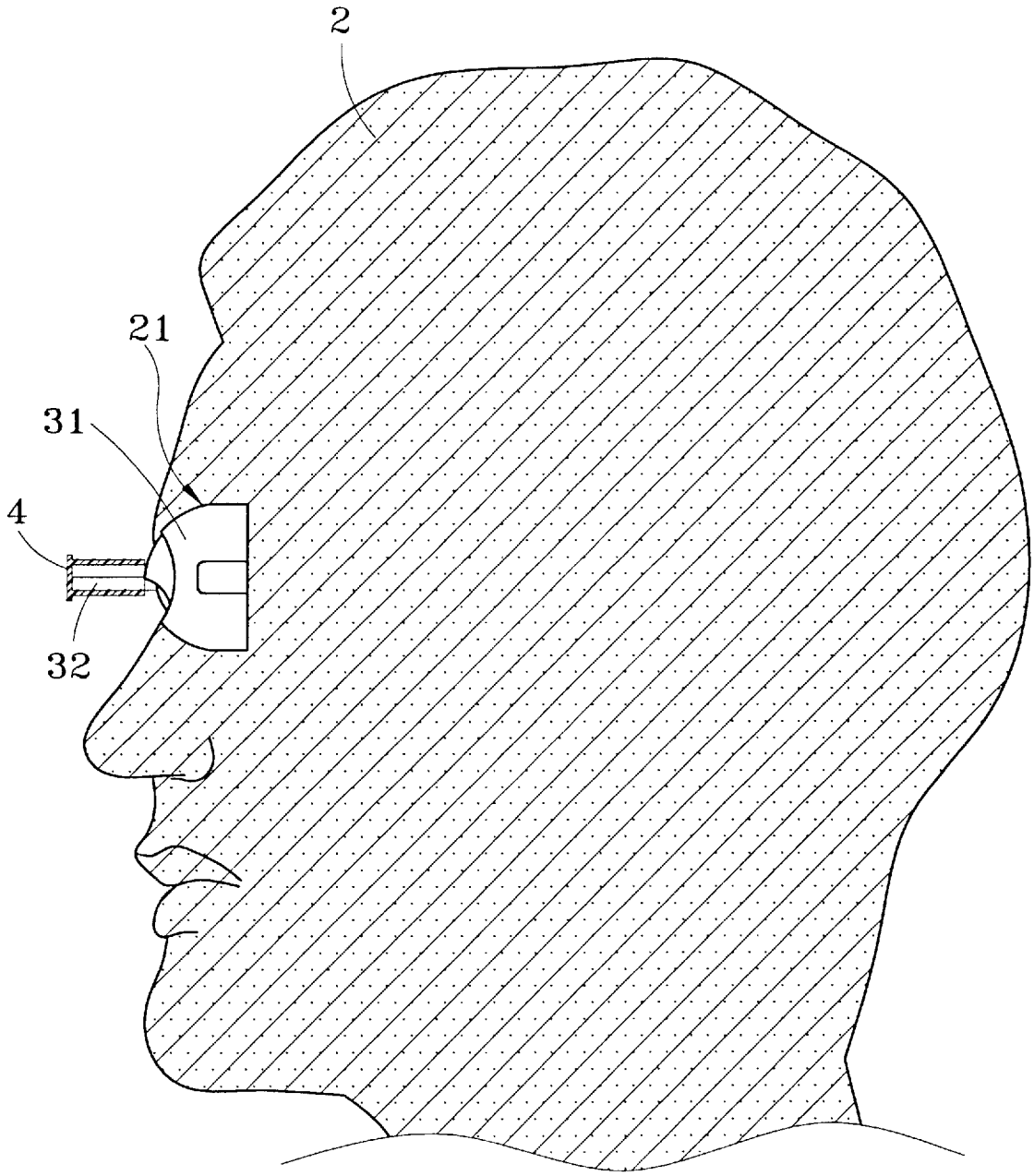
FIGS. 3A through 3G are schematic cross sections of the head model, head mold, and head finished product of the invention.

The first step 10 is to form a doll head model 2 from plastic clay, and to plant an eye model 31 in the model eye cavity 21. The eye model 31 is formed like an eyeball with an anchor strut 32 extending on the viewing focus of the eyeball. The anchor strut 32 is extended outside the head model and is coupled with an anchor sleeve 4 (as shown in FIG. 3A).

Figure 3B:
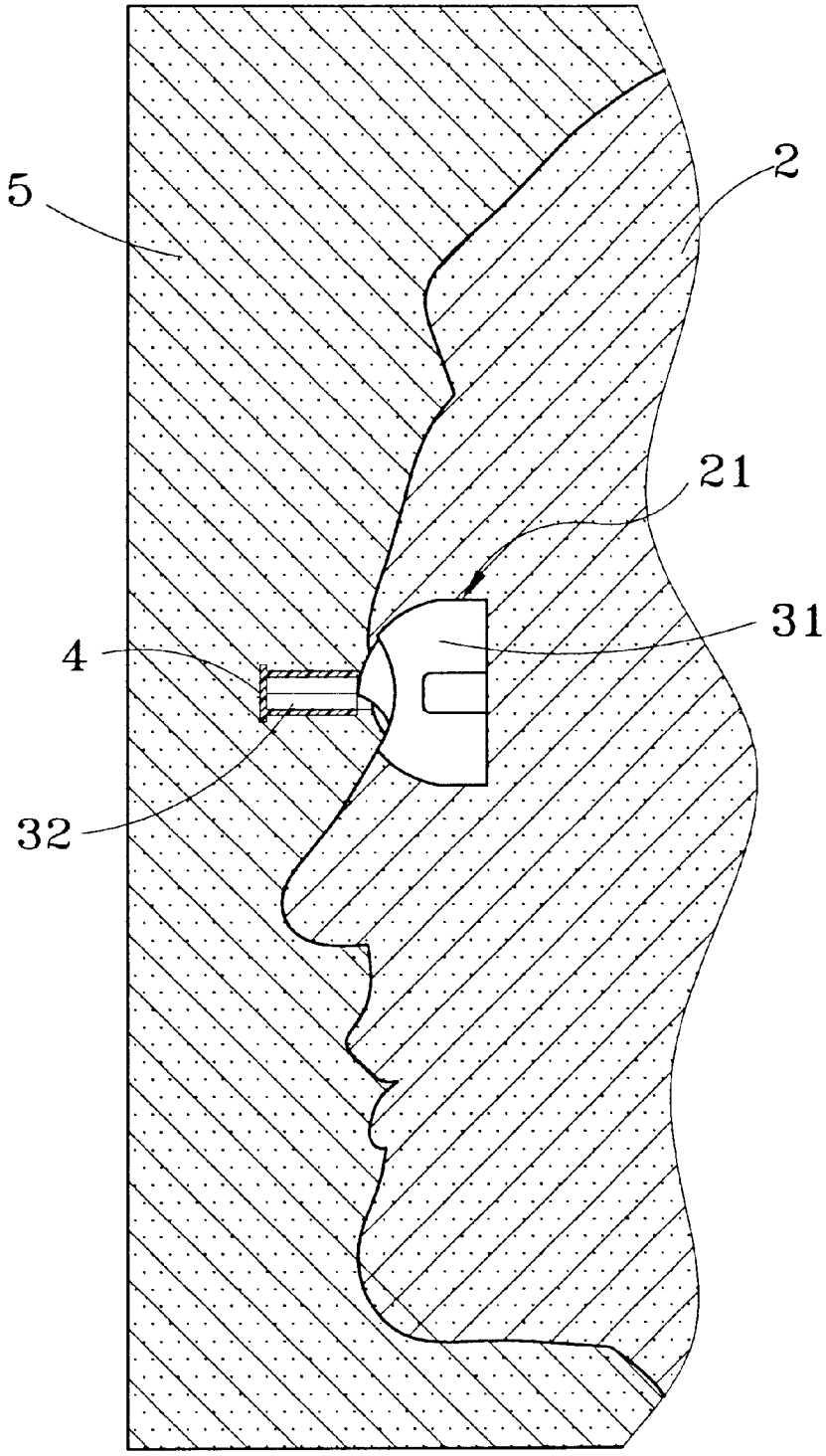
Figure 3C:
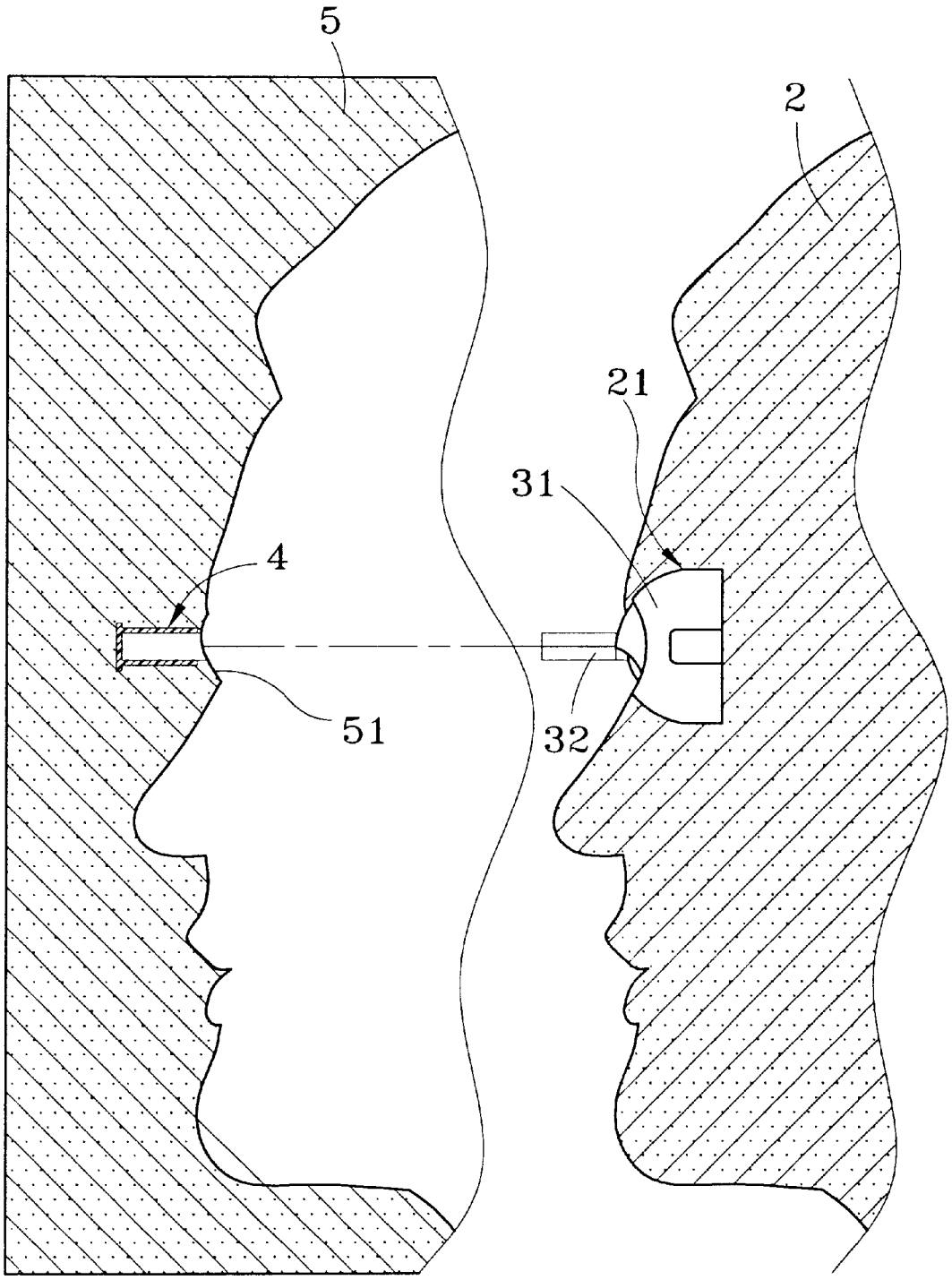

The head model 2 is finished at the first step 10. The second step 11 is to make a head mold 5 (as shown in FIG. 3B) according to the head model 2. When the head model 2 is released from the mold, the eye model 31 is removed from the head model 2. And the anchor sleeve 4 remains in the mold eye cavity 51 of the head mold 5 (as shown in FIG. 3C).

Figure 3D:
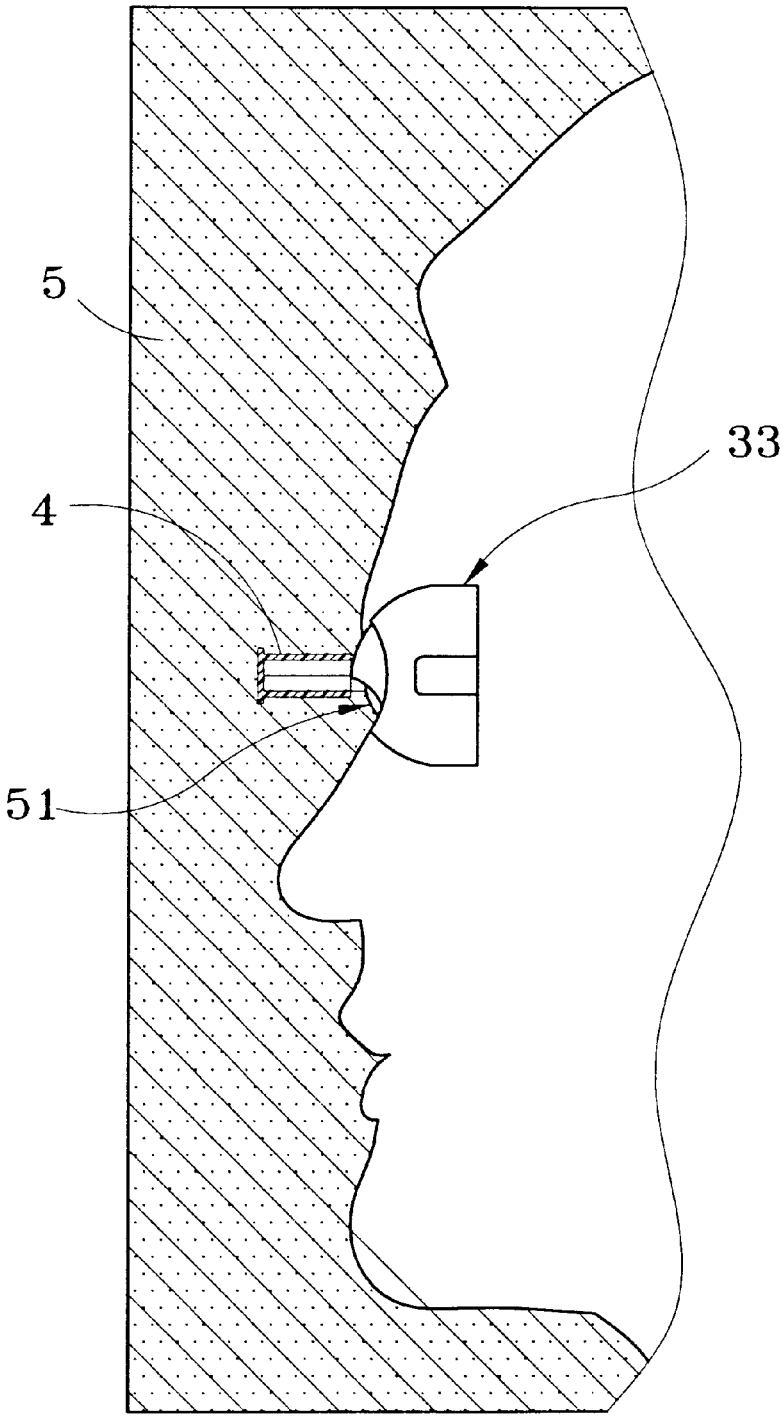

After the head mold 5 is completed at the step 11, the third step 12 is to couple another eye mold 33 on the anchor sleeve 4 (as shown in FIG. 3D).

Figure 3E:
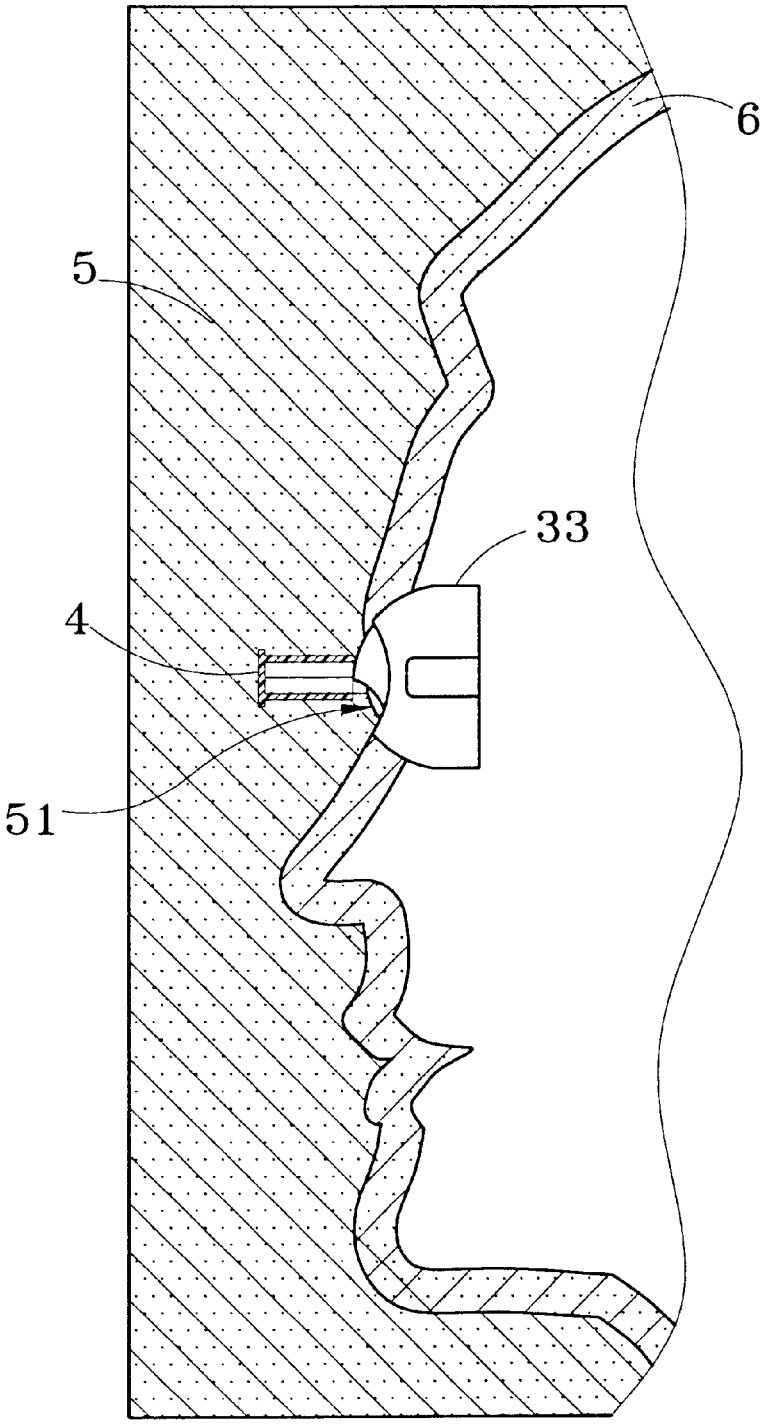
Figure 3F:
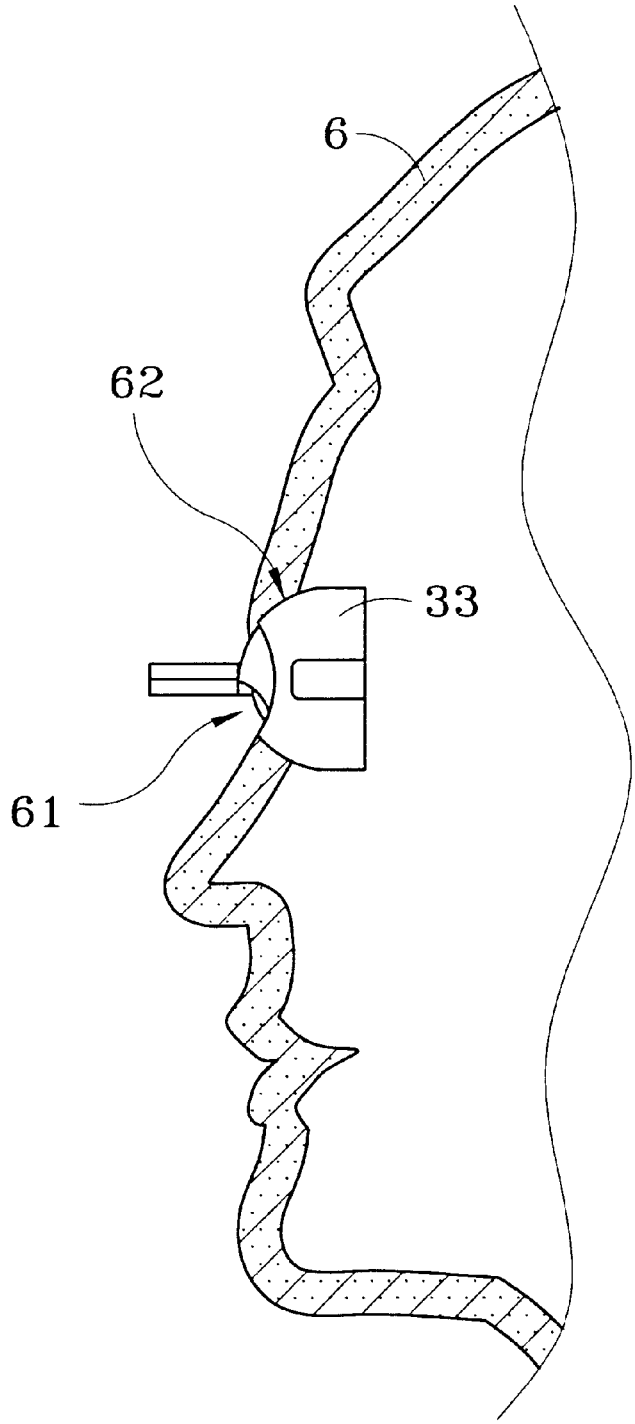
Figure 3G:
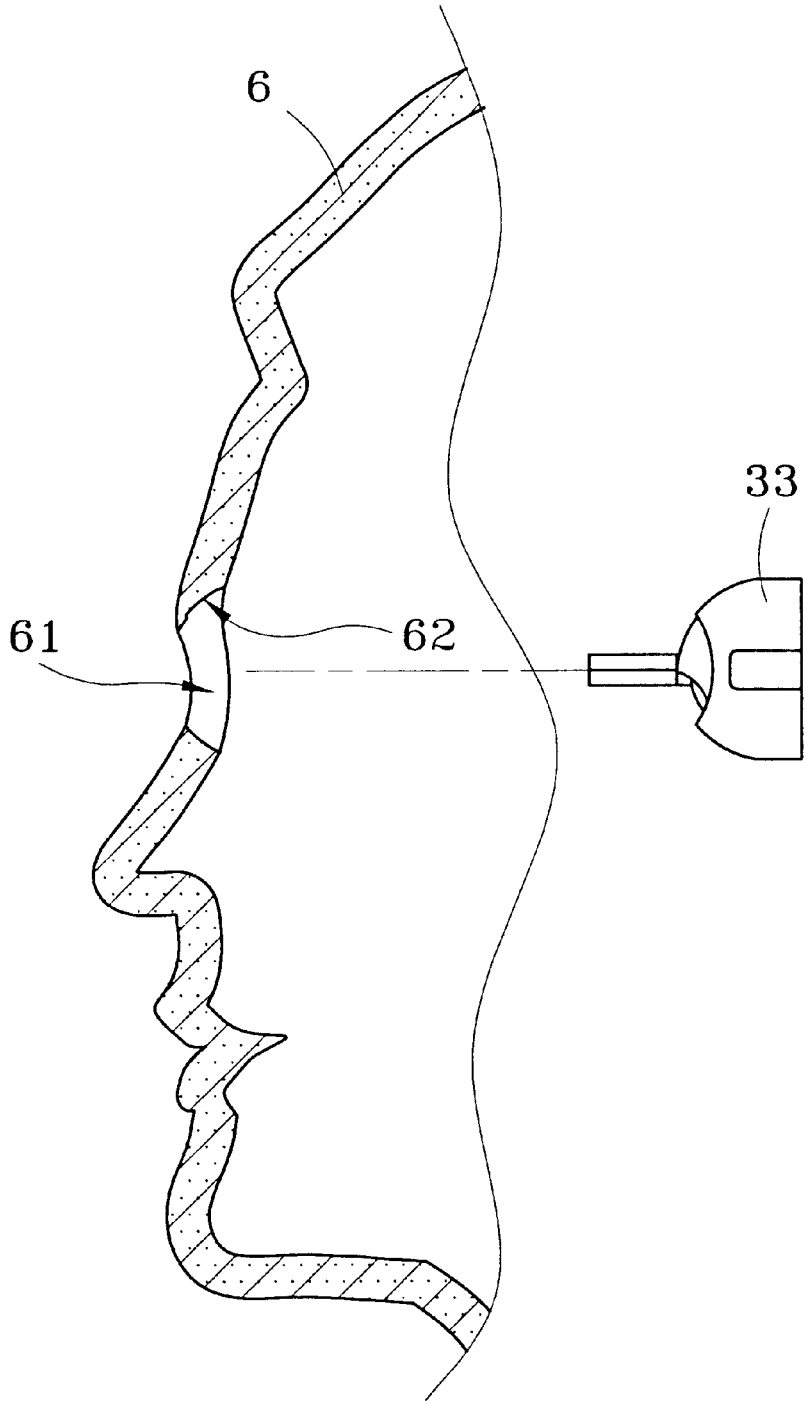

With the eye mold 33 coupled on the head mold 5 at the third step 12, then the fourth step 13 (referring to FIG. 3E) is to cast liquid ceramic clay in the head mold 5 with a selected thickness. After the ceramic clay is dried, remove the head finished product 6 which has the eye mold 33 attached thereon (as shown in FIG. 3F). Then remove the eye mold 33 (referring to FIG. 3G). The inner peripheral wall of the eye cavity 61 forms an installation zone 62 for the doll eyeball.

Figure 4:
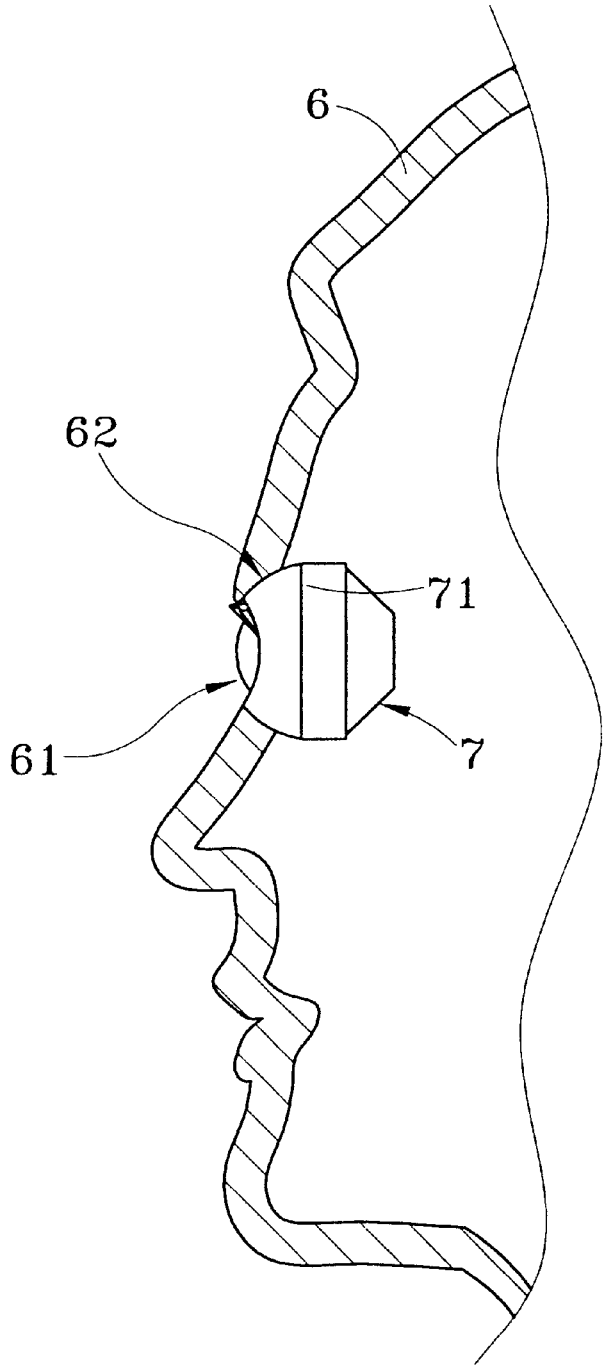
FIG. 4 is a schematic view of an embodiment of the invention.

Referring to FIG. 4, for installing the eye in the doll head, the eye mold 33 has a contour bigger than that of the doll eyeball 7 to reserve the contracted allowance when the mold is dried. Hence the inner rim contour of the installation zone 62 in the eye cavity 61 of the head finished product 6 is same as the eye mold 33. After the head finished product 6 is placed in a kiln and baked, the final head finished product 6 becomes a hard and brittle ceramic doll with the installation zone 62 to accommodate the doll eyeball 7 that has the same contour. Thus workers can install the doll eyeball 7 in the installation zone 62 in a simple operation. The doll eyeball 7 has a fastening section 71 to couple with the installation zone 62 in a secured manner without loosening off. In addition, the manufacturing method set forth above does not need to carve the eye cavity manually and does not need to polish and smooth the inner wall surface of the eye cavity in a curved shape to hold the eyeball that happen to the conventional techniques. Moreover, the anchor strut 32 of the eye mold 31 is located on the viewing focus at the initial stage, and maintains the same in the rest of the manufacturing process. Hence the doll eyeball 7 can maintain proper focus after installation without a skew or askance look. The method of the invention set forth above not only can save operation and time in adjusting the focus of the eyes, the installation zone 62 can also hold and accommodate new types of doll eyeball 7.

Furthermore, the anchor sleeve 4 is a pliable rubber sleeve. In the mass production process, every doll head 5 must have one anchor sleeve 4 to couple with one eye mold 33 to form the installation zone 62. The pliable anchor sleeve 4 may be repeatedly used to couple with the eye mold 33, and prevent the hard and brittle mold eye cavity 51 of the head mold 5 from expanding or cracking.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of making an installation zone for a ceramic doll eye to form an installation zone on an inner peripheral wall of a doll head eye cavity to accommodate a doll eyeball, comprising steps of:

forming a doll head model with a model eye cavity which has an eye model planted therein, the eye model having a front end attached to an anchor sleeve, the anchor sleeve extends outside the head model;

casting a head mold according to the head model, the head mold having a mold eye cavity, and releasing and removing the head mold with the anchor sleeve remaining in the mold eye cavity;

coupling another eye model on the anchor sleeve; and casting the head mold to form a finished head product, and then removing the another eye mold from the doll eye cavity of the finished head product to form the installation zone on an inner peripheral wall of the doll eye cavity to accommodate the doll eyeball.

2. The method of claim 1, wherein the anchor sleeve is a pliable rubber sleeve.

3. The method of claim 1, wherein the eye mold has a contour bigger than that of the doll eyeball.

4. The method of claim 1, wherein the doll eyeball is coupled securely with the installation zone.

5. The method of claim 1, wherein the installation zone has a shape which is alterable according to a shape of the eye model.

* * * * *